United States Patent [19]

Smith et al.

[11] Patent Number: 5,025,708

[45] Date of Patent: Jun. 25, 1991

[54] ACTUATOR WITH AUTOMATIC LOCK

[75] Inventors: Denzil B. Smith; Melvyn F. Whitby, both of Houston, Tex.

[73] Assignee: Baroid Technology, Inc., Houston, Tex.

[21] Appl. No.: 472,644

[22] Filed: Jan. 30, 1990

[51] Int. Cl.[5] ..... F15B 15/26

[52] U.S. Cl. ..... 92/19; 92/23; 92/27; 92/28

[58] Field of Search ..... 92/18, 19, 20, 23, 24, 92/25, 27, 28, 30; 251/1.1, 1.2, 1.3

[56] References Cited

U.S. PATENT DOCUMENTS

| | | | |
|---|---|---|---|
| 2,927,432 | 3/1960 | Parry | 92/18 X |
| 3,050,943 | 8/1962 | Thorel et al. | 92/18 X |
| 3,242,826 | 3/1966 | Smith | 92/24 |
| 3,251,278 | 5/1966 | Royster | 92/18 |
| 3,918,478 | 11/1975 | Le Rouax | 137/315 |
| 3,941,141 | 3/1976 | Robert | 92/18 X |
| 4,076,208 | 2/1978 | Olson | 251/1.3 |
| 4,188,860 | 2/1980 | Miller | 92/20 X |
| 4,290,577 | 9/1981 | Olson | 251/1.1 |
| 4,293,115 | 10/1981 | Parks, Jr. et al. | 251/1.1 |
| 4,305,565 | 12/1981 | Abbe | 251/1.1 |
| 4,519,571 | 5/1985 | Jones et al. | 251/1.1 |
| 4,523,639 | 6/1985 | Howard, Jr. | 166/55 |
| 4,601,232 | 7/1986 | Troxell, Jr. | 92/24 |
| 4,840,346 | 6/1989 | Adnyana et al. | 251/1.1 X |
| 4,969,627 | 11/1990 | Williams, III | 92/24 X |

OTHER PUBLICATIONS

"Cameron Type U Blowout Preventers", pp. 1282 and 1283.

"MPL Automatic Ram Locking", pp. 4490 and 4491.

*Primary Examiner*—John T. Kwon

*Assistant Examiner*—John Ryznic

*Attorney, Agent, or Firm*—Browning, Bushman, Anderson & Brookhart

[57] ABSTRACT

An improved blowout preventor actuator is provided for opening and closing a ram block within a blowout preventor body to control the flow of well fluid. The working or power piston within the actuator cylinder is provided with one or more axially extending cavities each for receiving a locking rod secured at one end to the cylinder head. To prevent inadvertent opening of the ram block, locking segments carried by the power piston repeatedly disengage one locking surface and re-engage an adjacent locking surface on the locking rods as the power piston and ram block secured thereto move to the ram closed position. To unlock the power piston from the locking rods, fluid pressure is applied to an unlocking piston which radially moves the locking segments out of engagement with the locking rods. The locking surfaces on the locking rods extend axially along a length which allows different ram blocks to be substituted for sealing with various diameter tubular members passing through the blowout preventors. The simple yet highly reliable technique for preventing opening of the BOP ram block increases safety and reduces manufacturing and operating costs.

26 Claims, 3 Drawing Sheets

ACTUATOR WITH AUTOMATIC LOCK

BACKGROUND OF THE INVENTION

1. Field of the Invention

The present invention relates generally to actuators having safety mechanisms for locking the axial position of the actuator piston with respect to the actuator cylinder. More particularly, the invention relates to a simple and reliable fluid-powered BOP actuator which mechanically locks the ram secured to the piston in multiple closed positions to maintain the flow path through the BOP sealed off even though fluid pressure to the actuator is interrupted.

2. Description of the Background

Blowout preventors (BOPs) are used in oil field operations to close off the flow path either through a tubular string or through an annulus between the tubular string and the BOP body. The BOP actuators are typically fluid-powered to effect both closing and opening of the ram shafts which each axially move within a respective actuator cylinder. Actuators on opposing sides of the BOP body typically press ram blocks together simultaneously to close off the desired flow path through the BOP. BOPs are often actuated to seal off a well during an emergency or during well shutdown operations prior to anticipated inclement weather at offshore installations.

Since the supply of pressurized fluid to the BOP may become interrupted after closing of the BOP, actuators have been designed with the various types of safety mechanisms to lock or fix the ram shaft in its closed position and thereby prevent inadvertent release of the closing pressure on the ram. Since BOPs are often located in sub-sea or other remote environments, BOP actuators and lock mechanisms associated therewith must be highly reliable. Those skilled in the art appreciate the significant safety and environmental risks resulting from the inadvertent opening of the BOP rams, and accordingly both primary and backup systems have been devised to prevent this occurrence.

Prior art BOP ram actuators were initially equipped with locking mechanisms which fixed the position of the piston at a single axial location within the actuator cylinder, and thus fixed the ram in a single closed position. An example of BOP actuator with such a lock mechanism is disclosed in U.S. Pat. No. 3,242,826. The lock mechanism includes expandable locking segments which engage an annular recess in the cylinder wall and thereby lock the ram shaft position with respect to the actuator cylinder. A single position lock mechanism has several drawbacks, however, since wear of the ram block components requires continual adjustment of the lock mechanism to achieve a lock condition and thereby seal off the flow path through the BOP at a reliable sealing pressure.

Another problem associated with BOP lock mechanisms concerns the goal of minimizing the frictional drag during normal operation of the actuator between the locking elements which axially fix the ram shaft within the actuator cylinder, while simultaneously providing a locking mechanism which cannot be overcome and thereby allow opening of the ram shaft before the locking mechanism is intentionally disengaged. U.S. Pat. No. 4,519,571 discloses actuator locking elements which are wedged outwardly along a locking shoulder of the cylinder as the ram is moved towards its closed position. Unless fluid pressure is available to maintain the locking elements in their closed position, however, the locking elements can be disengaged by overcoming frictional forces between the locking components. The above patent discloses a locking mechanism capable of achieving a lock at various axial locations, although within a relatively narrow range. While locking mechanism adjustment for ram block component wear is minimized, the same BOP actuators cannot be reliably used with different ram blocks for locking about different sized pipes passing through the BOP. Moreover, the reliability of the locking mechanism is dependent on maintaining fluid pressure to the BOP to keep the locking elements in their closed position.

A multiple-position locking mechanism commercially offered by Hydril allows BOP actuator lock at various positions, so that the ram block may seal off with a high closing force although the seals on the ram block wear. The ram is closed by hydraulic pressure, and is maintained closed by a unidirectional clutch, lock nut, and threaded tail rod assembly. Forces attempting to open the ram are transmitted through the tail rod to the lock nut and then to the locked clutch plates. Hydraulic pressure is used to disengage the clutch plates and thereby permit the lock nut to rotate on the tail rod to allow the ram shaft to open. This locking mechanism is complex and is thus considered costly to maintain. The locking mechanism undesirably increases the diameter of the BOP assembly since the tail rod and clutch assembly are axially aligned with and extend from the actuator cylinder at a location opposite the ram blocks.

Each of the prior art BOP actuators with locking mechanisms thus has significant disadvantages relating to reliability, versatility, and/or cost. Single or dual position locking mechanisms do not provide the desired lock closing pressure once ram seals wear. Locking devices which effect locking at multiple axial locations along a narrow range cannot be used with interchangeable ram blocks to seal off various diameter tubular passing through the BOPs. Since fluid pressure to the BOPs may become interrupted either during an emergency or during a long delay after a BOP is closed, actuator locking mechanisms which require fluid pressure to ensure locked engagement of the ram shaft within the cylinder do not offer the desired high reliability. Locking mechanisms which rely on frictional engagement of components are undesirable since the lock device may fail if sufficient opening pressure is applied to the actuator ram. A locking mechanism which includes a unidirectional clutch, lock nut, and threaded tail rod assembly is costly and undesirably increases the size and complexity of the BOP. Most prior art locking mechanism cannot practically be incorporated into existing BOP actuators, and accordingly high replacement costs are required to provide a BOP with a versatile actuator locking device.

The disadvantages of the prior art are overcome by the present invention, and an improved blowout preventor actuator is hereinafter disclosed which simply and reliably locks the position of a BOP ram at multiple locations extending axially over a relatively long range. The actuator need not be repeatedly readjusted for ram block wear, and the same actuator may be used with replaceable ram blocks to close off various diameter flow passageways through the BOP.

SUMMARY OF THE INVENTION

A fluid-powered BOP actuator includes a cylinder having a central axis, a power piston movable within the cylinder, and a ram shaft extending from the cylinder for interconnecting the power piston and a ram block. At least two BOP actuators are provided on opposing sides of a BOP body for opening and closing their respective ram blocks to control flow of well fluid through the BOP. The BOP has a through aperature for receiving tubular members of various diameters which extend into the well bore.

In a suitable embodiment, a power piston is provided with a plurality of axially extending locking cavities. A plurality of locking rods are each secured at one end to the cylinder head, such that each of their opposing ends extends into and is axially movable within a corresponding locking rod cavity. A plurality of locking segments are each carried on the power piston and cooperate with corresponding locking rod to normally prevent the power piston from moving toward the cylinder head and opening the ram block. An unlocking piston also carried on the power piston is axially movable in response to fluid pressure to cause fingers having tapered surfaces thereon to engage and unlock the locking segments from the locking rods. The same fluid pressure applied to the unlocking piston may be used to move the power piston to the ram open position.

Each of the locking rods has a multiplicity of axially spaced locking surfaces thereon, with each locking surface preferably being substantially perpendicular to the central axis of the cylinder bore. Each locking segment includes a plurality of mating surfaces for engaging and locking with corresponding locking surfaces on a locking rod. A spring biases each locking segment into engagement with its locking rod, thereby permitting the locking segments to ratchet along the locking rods as the ram block is powered to its closed position. The loss of fluid pressure to a closed actuator does not allow the ram blocks to open, since the power piston is prevented from moving toward the cylinder head until the locking segments are disengaged from the rods.

The locking surfaces on the locking rods may be formed by a plurality of external grooves which engage mating grooves on the locking segments. The external grooves for one locking rod may be axially offset from the grooves of another rod, so that one locking segment engages and locks with its corresponding locking rod between the disengagement and subsequent engagement of another locking segment with adjacent grooves on its locking rod. The external grooves are preferably provided along each locking rod over a length of at least 45% of the nominal diameter of the aperature through the BOP for receiving the tubular members, so that ram blocks may be replaced for accomodating different size tubular members passing through the BOP without altering or adjusting the actuator cylinder or the locking mechanism.

It is an object of the present invention to provide a simple yet highly reliable actuator for a BOP which prevents inadvertent opening of the ram block until fluid pressure is applied to intentionally open the actuator.

Another feature of the invention is that the locking surfaces on the locking rods are spaced axially over a length which allows replacement of different ram blocks on the ends of a ram shaft to accommodate various diameter tubular members passing through the BOP without requiring modification of the actuator cylinder or the locking mechanism to achieve locking.

It is another object of the invention to provide improved techniques for mechanically locking a BOP actuator piston in a closed position within a cylinder without relying upon the maintenance of fluid pressure to the actuator or frictional forces between locking components.

It is a feature of the present invention that a positive lock between the working piston and the actuator cylinder is obtained by provided locking surfaces on the locking rods which are substantially perpendicular to the central axis of the cylinder bore.

Yet another feature of the invention is that existing BOP actuators can be economically retrofitted to include the locking mechanism of the present invention to prevent inadvertent reopening of the BOP actuator.

It is an advantage of the present invention that the locking surfaces for one of the locking rods are axially offset from engagement with the mating surface on a corresponding locking segment while the locking surfaces on another of the locking rods are in locked engagement with the mating surface on its corresponding locking segment.

Still another advantage of the present invention is that fluid pressure which is applied to the actuator to move the locking segments out of engagement with the locking rods is also used to move the power piston to its opened position.

These and other objects, features, and advantages of the present invention will become apparent from the following detailed description, wherein reference is made to the figures in the accompanying drawings.

DETAILED DESCRIPTION OF PREFERRED EMBODIMENTS

Figure 1:
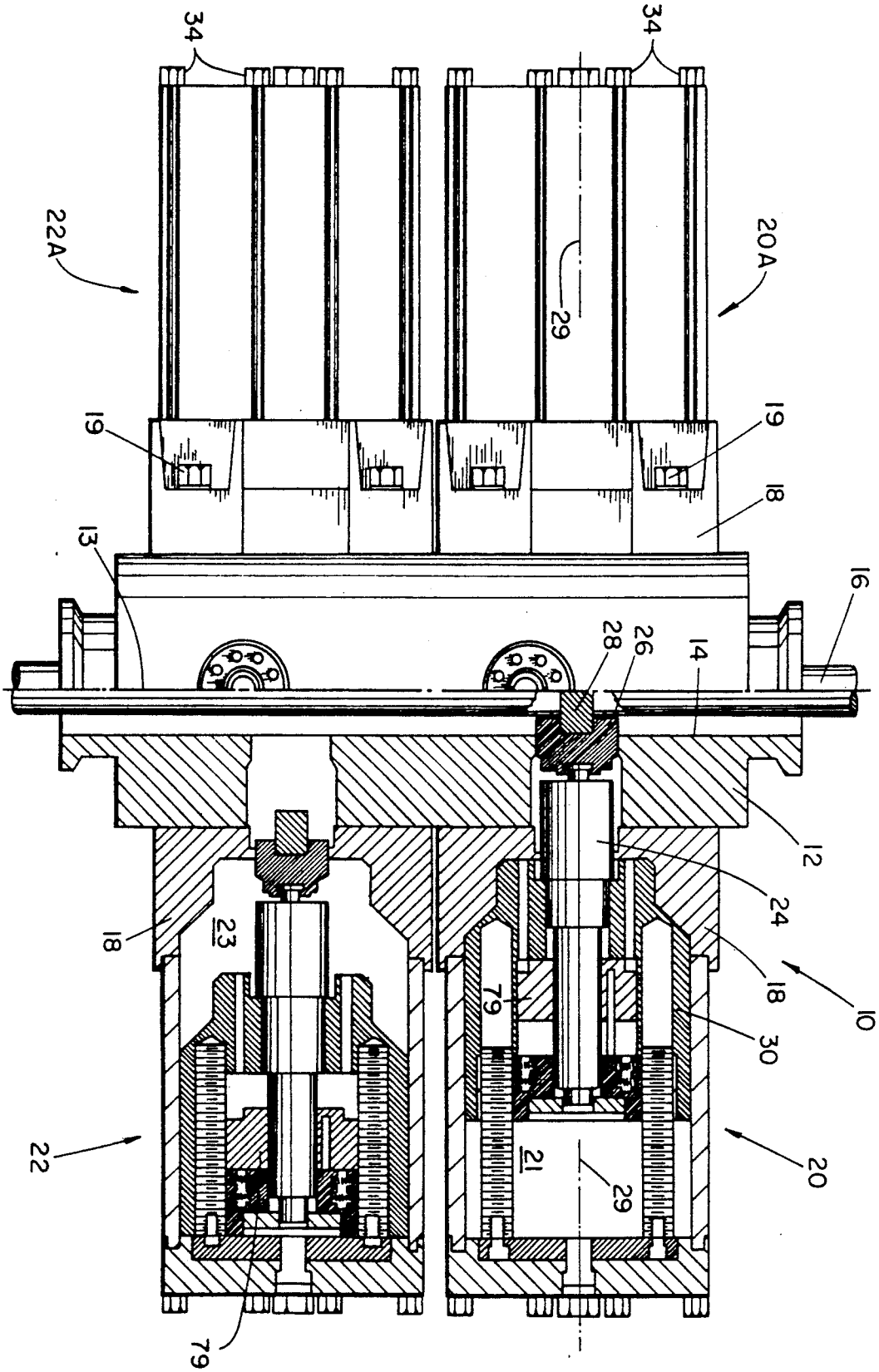
FIG. 1 is a pictorial view, partially in cross-section, of a suitable blowout preventor according to the present invention.

FIG. 1 illustrates a blowout preventor (BOP) 10 including a plurality of fluid powered actuators 20, 22 according to the present invention. BOP 10 includes an annular body 12 having a passageway 14 extending therethrough for receiving tubular members 16 which pass through the BOP and extend into a well bore. Those skilled in the art appreciate that the body 12 can receive tubular members of various diameters. Different ram blocks discussed subsequently may each be mounted on the actuators for sealing with a particular diameter tubular, e.g., 7-$\frac{5}{8}$" casing. The rated size of the BOP is determined by the maximum diameter tubular which may be passed through the BOP passageway 14.

The most restrictive diameter of the BOP passageway 14 thus has a nominal diameter which is able to receive lengths of drill pipe or other tubular members up to a maximum tubular diameter which may be passed through the BOP while allowing sufficient clearance for drill collars, pin and box connections, etc.

The depicted BOP 10 includes two structurally identical upper actuator assemblies 20, 20A provided on opposing sides of the BOP body. Each assembly 20, 20A may be structurally connected by bolt and nut assemblies 34 to a BOP door 18, which in turn is mounted on body 12 by other bolt and nut assemblies 19. The lower actuator assemblies 22, 22A are typically also identical and are similarly provided on opposing sides of the BOP body. Both opposing upper and lower actuators may be simultaneously activated so that the ram blocks press and seal on opposing sides of the tubular member 16 while maintaining the member 16 substantially axially centered within the passageway 14. In FIG. 1, the upper actuators 20, 20A are in a closed position with the ram block sealing about the tubular member 16, while the lower actuators 22, 22A are in a fully opened position.

Each of the actuators 20, 22 includes a piston assembly which reciprocates along the central axis 29 of each actuator assembly. Each actuator is fluid-powered, and pressurized fluid in the ram closing chamber 21 of the actuator moves the piston and its associated ram block to a ram closing position, while pressurized fluid in ram opening chamber 23 moves the piston and ram block to the open position (see actuator 22 depicted in FIG. 1). The axes 29 of the assemblies 20, 20A are coaxial, and pass through and are perpendicular to the central axis 13 of the BOP passageway 14. A ram shaft 24 mechanically interconnects each piston assembly 30 with a replaceable ram block 26, and includes at least one sealing element 28 mounted thereon. Each of various available ram blocks 26 may thus be mounted on a respective ram shaft of each actuator for sealing with a selected diameter tubular member to seal off a flow path between the body 12 and the tubular member 16. Alternatively, conventional ram blocks may be used which shear through the tubular member 16 then completely close off the flow path through the body 12.

The ram blocks for both the upper actuators and the ram blocks for lower actuators may be identical if redundant sealing is desired. Alternatively, the upper set of ram blocks may be provided for sealing about one size tubular member, while the lower set of ram blocks may be actuated for sealing about a different size tubular member. In this case, either the upper or lower actuators may be selectively activated so that the same BOP may seal off against either of two diameter tubulars which may pass through the BOP and into the well bore. In yet another embodiment, the upper ram blocks may be intended for sealing about the annulus between the tubular member and the BOP body 12, while a second lower set of ram blocks is designed to shear the tubular member and completely close off any fluid flow through the BOP.

Figure 2:
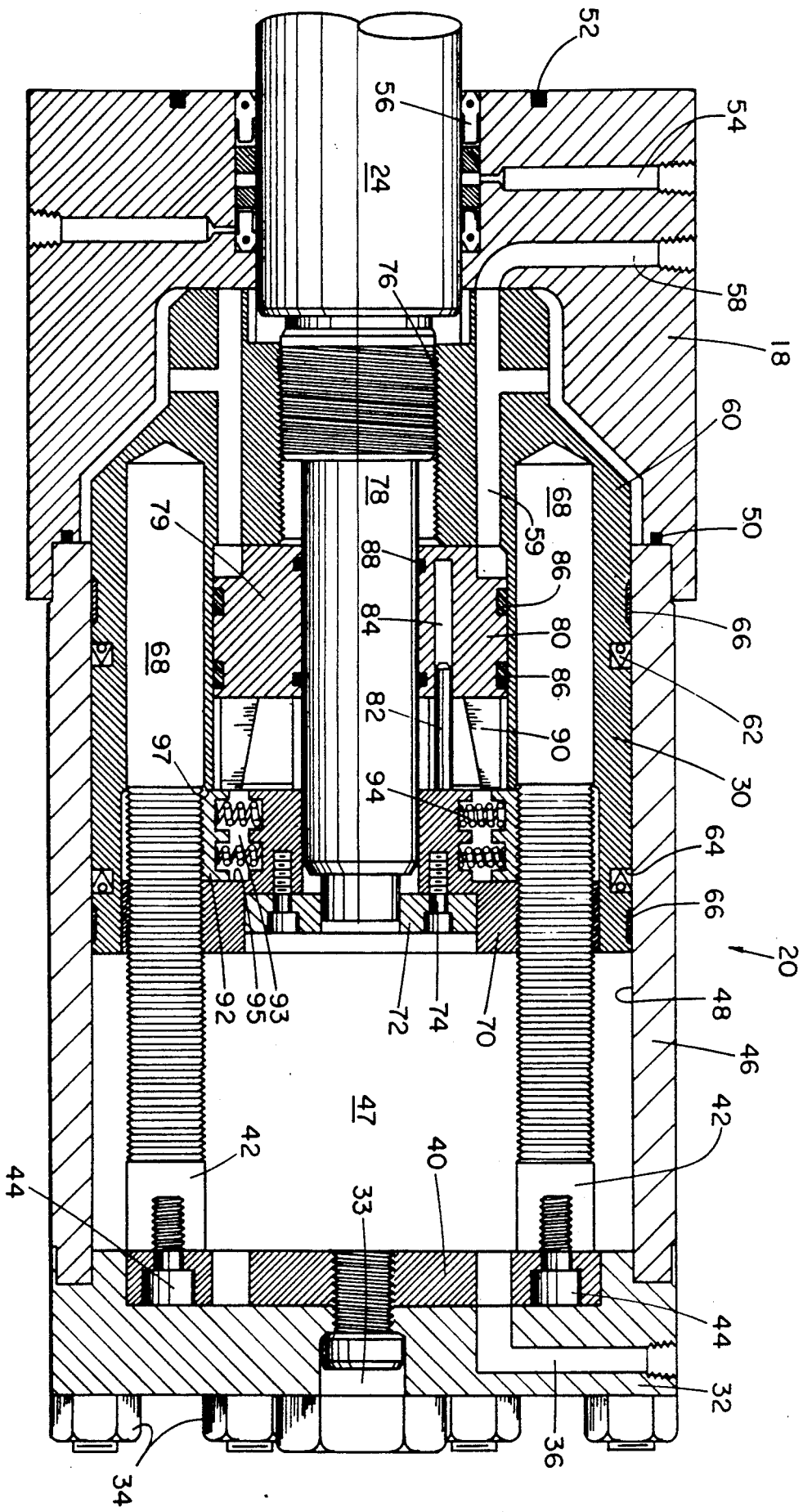
FIG. 2 is a detailed view, partially in cross-section, of one of the blowout preventor actuators generally shown in FIG. 1.

FIG. 2 depicts in greater detail the actuator 20 generally shown in FIG. 1. The fluid-powered actuator includes a sleeve-shaped outer housing or cylinder 46 having a inner cylindrical surface 48 which defines the central axis 29 of the actuator. A cylinder head 32 is sealing secured at one end of the cylinder 46, and the cylinder and cylinder head may be simultaneously secured to the door 18 by the bolt and nut assemblies 34. A locking rod plate 40 is connected to cylinder head 32 by a central shoulder bolt 33. A plurality of locking rods 42 in turn are each secured at one end to the locking plate 40 by a mounting bolt 44. Preferably more than one locking rod is provided according to the present invention, and each rod 42 is spaced a uniform distance from and is symmetrically positioned about the central axis of the actuator 20. In a preferred embodiment, four locking rods 42 are provided and are spaced at 90° intervals about the axis 29.

The piston assembly 30 axially movable within the cylinder 46 comprises a mandrel 60 having a plurality of axially extending locking rod cavities 68 therein. Each cavity it aligned and sized for receiving the free or cantilevered end of one of the locking rods 42 during reciprocation of the power piston assembly 30 within the cylinder 46. Conventional seals 62 and 64 maintain fluid-tight sealing engagement between the outer cylindrical surface of the mandrel 60 and the inner surface 48 of the cylinder 46, while wear sleeves 66 maintain the power piston 30 axially centered within the cylinder 46. Retainer plate 70 is structurally connected to the mandrel 60 by bolts (not shown) while locking plate 72 is similarly fixed to the retainer plate by bolts 74.

A plurality of locking segments or half-nuts 92 are carried on the piston 30, with each segment 92 being spaced radially between a respective locking rod 42 and the central axis of the actuator. Each locking segment is movable within a respective cavity 93 within the piston 30, with movement of the segments 92 perferably being restricted to radial movement by guide surfaces 95, 97 on the retainer plate 70 and the mandrel 60, respectively. Each locking segment is biased toward engagement with its respective locking rod by a pair of coil springs 94. As explained more fully below, the locking segments 92 do not restrict the piston 30 from moving the ram block to a closed position, as shown in FIG. 2, but do cooperate with the locking rods 42 to prohibit the piston 30 from moving to an open position until fluid pressure is applied to intentionally move the piston 30 to its open position.

Ram shaft 24 includes a reduced diameter end 78 having threads 76 which structurally connect the ram shaft to the power piston 30. Seals 56 maintain sealed engagement between the ram shaft 24 and the door 18 during reciprocation of the power piston within the cylinder. Additional sealing or packing material may be applied to the ram shaft through input port 54 in the door 18. Seals 52 on the door 18 seal with the BOP body 12, while seals 50 seal between the door 18 and the cylinder 46.

A ring-shaped unlocking assembly 79 is radially positioned between the locking rod cavities 68 and the end 78 of the ram shaft. An unlocking piston 80 is axially movable within a power piston in response to fluid pressure. Seals 86 on the outer diameter surface of the piston 80 provide sealing engagement with the mandrel 60, while seals 88 on the inner diameter surface of the unlocking piston seal with a piston end 78 of the ram shaft 24. The end 78 is axially secured to the retainer plate 70 and the mandrel 60 to form the working piston or piston assembly 30. A plurality of fingers 90 extend from the unlocking piston 80, with each finger adapted to engage and radially retract a corresponding locking segment 92 from locked engagement with a respective locking rod 42. Proper angular orientation of the fingers 90 with respect to the locking segments is obtained by guide pin 82 secured to the retainer plate 70 and slidable within a cylindrical cavity 84 in the unlocking piston 80.

Figure 3:
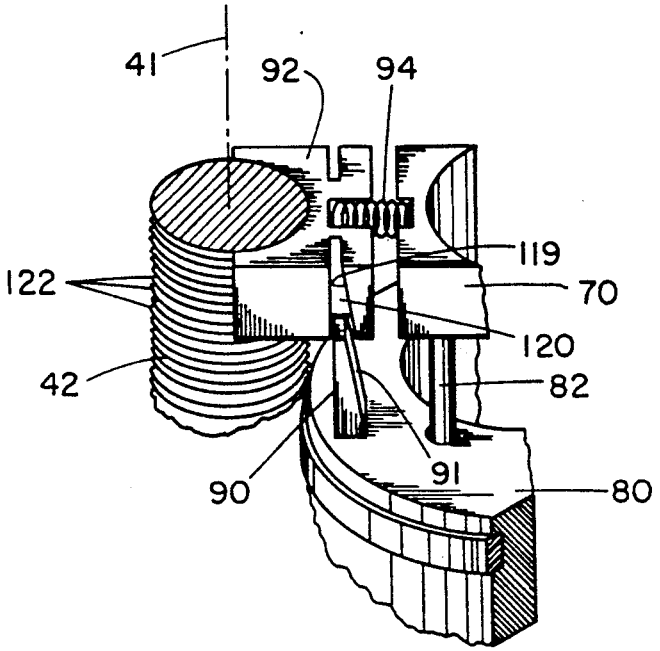
FIG. 3 is a simplied pictorial view, partially in cross-section, illustrating locked engagement of a locking segment with a locking rod as generally shown in FIG. 2.

FIGS. 3 depicts in greater detail the components of the locking mechanism according to the present invention. The locking rod 42 includes a multiplicity of axially spaced external grooves 122. The locking segment has similar grooves provided along its radially outward arcuate surface 93. Locking segment 82 also includes a slot 120 defining a tapered surface 122 for sliding engagement with a similarly tapered surface 91 on the finger 90 secured to the unlocking piston 80. In FIGS. 2 and 3, the unlocking piston 80 is in its locked position, wherein surfaces 91 and 92 are out of engagement. In this position, locking segment 92 is biased by springs 94 for locked engagement with the locking rod 42.

Figure 4:
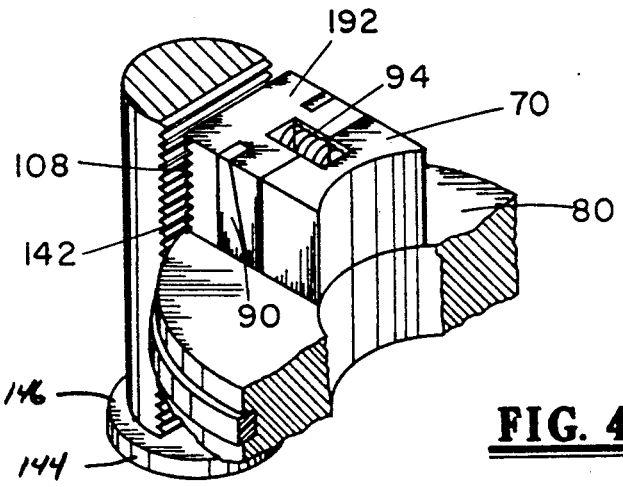
FIG. 4 is a pictorial view of an alternate embodiment of the locking components shown in FIG. 3, with the locking segment moved out of engagement with its locking rod.

FIG. 4 depicts an alternate embodiment of a locking segment and locking rod, wherein the unlocking piston has been moved radially inward toward axis 29 to its unlocked position, causing the surface 91 to engage surface 119 and thereby retract the locking segment from its locking rod and compress springs 94. In FIG. 4, the locking rod 142 is semicylindrical in configuration. Accordingly, the locking teeth lie within a plane, and the mating teeth on the modified locking segment 192 similarly lie within a parallel plane. The modified locking segment 192 is thus moved radially with respect to the actuator axis 29 into and out of engagement with the locking rod 142 by the axial movement of the piston 80. One advantage of the latter described embodiment is that, for the same tooth profile, less radial movement of the locking segment is necessary to disengage each locking segment from the locking rod than is necessary if the locking teeth and mating teeth are each curved. In the embodiment as shown in FIG. 3, the ends of each tooth do not move with respect to the rod axis the full travel of the locking segment as it moves radially with respect to the actuator axis, and accordingly portions of each mating tooth disengage from a respective locking tooth while other portions remain in engagement. In the latter embodiment, however, each portion of the length of each mating tooth simultaneously moves out of engagement with the respective locking tooth. Once the locking segments have been retracted from their respective locking rods, the piston 30 is free to move axially toward the cylinder head 32 of the actuator.

Figure 5:
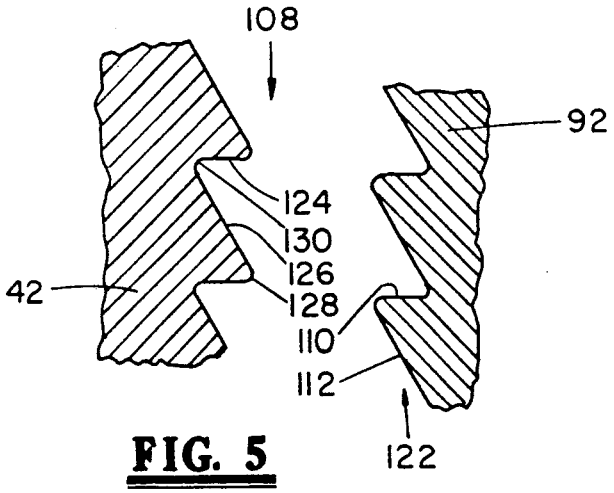
FIG. 5 is a cross-sectional illustration of the locking grooves on both the locking rod and the locking segment.

FIG. 5 depicts in greater detail the profile for the locking grooves on the locking rods and the mating grooves on the locking segments described above. For ease of manufacturing and assembly, each locking groove may be provided circumferentially about the rod 42, although only a portion of each groove 122 engages the locking segment 92 during operation of the actuator. Only the planar surface of the locking rod 142 is provided with locking grooves. In either case, the grooves 122 are preferably a series of axially-spaced recesses forming "teeth" on the rod. The axial position of each groove forming a tooth spaced along the rod is thus constant for ease of manufacturing, which also positions the teeth on the rod 42 independent of the rotational orientation of the rod 42 within the actuator cylinder. Each groove defines a locking surface 124 which preferably is perpendicular to or substantially perpendicular to the central axis 29 of the actuator. A tapered surface 126 extends axially between adjacent locking surfaces 124. Internal rounded corner 130 of each groove connects the locking surface with the tapered surface, while an external rounded corner 128 interconnects the opposing end of the tapered surface with a locking surface.

The locking surface 124 formed by each of the axially spaced grooves on the locking rods provides a positive stop which does not allow unintended opening of the ram block even if a high opening force is applied to the piston 30. Each locking surface 124 preferably lies within a plane perpendicular to the central axis 29 of the actuator. Each locking surface 124 could be tapered slightly from a plane perpendicular to the actuator axis (thereby forming frustroconical locking surfaces on rod 42 or tapered planar locking surfaces on rod 142), although the taper of the surface 124 should be at least 80°, and preferably between 85° and 90°, with respect to the central axis 41 of the rod. A slight rearward taper for the locking surface 124 may be provided, so that the radially outward end of each surface 124 adjoining 128 was spaced axially closer to cylinder head 32 than the radially inward end of that surface adjoining 130. Such a slight rearward taper would result in very little force tending to separate a locking segment from its rod in response to opening forces being applied to the ram block, and may reduce the force required to unlock the segment from a locking rod. A slight forward projecting taper for the locking surface 124 (placing the apex of the frustroconical surface axially between that locking surface and the cylinder head 32) provides the desired positive lock, but may cause difficulties with the retraction of a locking segment from the locking rod. To ensure that the locking segments easily move toward the free end of each locking rod as the actuator is closed, the ramp surfaces 126 between the locking surfaces are preferably forwardly tapered at about 30° with respect to the axis 41 of each rod, and the springs 94 are sized to provide a nominal biasing force sufficient to ensure that the segments engage their respective locking rods.

The profile for each of the mating grooves 108 on the locking segments 92 or 192 may be identical to that of the grooves 122 on the locking rods 42. The axial spacing of the mating grooves 108 thus is identical to the spacing of the grooves 122 on the locking rod. The geometric shape of the surface on which the mating grooves 108 are formed conforms to the shape of that portion of the exterior surface of the respective locking rod which contains the locking teeth, so that the length of each of the mating grooves is filled by one of the teeth on the locking rod during locked engagement. The locking surface 124 thus engages a mating surface 110 on locking segment 92 to prevent opening of the actuator. Ramp surfaces 126 and 112 are repeatedly in sliding engagement and cooperate with the springs 94 to achieve a ratcheting action between the locking segments and the rods during opening of the actuator.

The locking grooves 122 and mating grooves 108 are spaced axially relatively close together so that a desired seal squeeze may be maintained by the ram blocks without adjustment of the locking components for wear of the ram block seals. The close axial spacing of the locking surfaces 124 thus ensures that the ram block will be locked in substantially its fully closed position even though fluid pressure to the BOP is interrupted. Preferably the grooves are axially spaced so that adjacent locking surfaces are less than about 0.150" from each other. Although axial spacing of the locking grooves at less than 0.050" along each rod is possible to further reduce the "play" between any final ram closed position and the locked position, this further reduction in axial spacing results in either an undesirable increase in the taper of the ramp surfaces or an undesirable reduction in the axial force which the teeth formed by the grooves may withstand while a locking segment is locked to the locking rod.

The desired reduction in play accompanied by a decrease in the axial spacing of the grooves may be accomplished by axially offsetting the position of the locking surfaces on one rod relative to the locking surfaces on another rod, while maintaining the mating surfaces for all locking segments at the same axial position. Assuming the locking surfaces on each of two locking rods were spaced 0.100" apart, each locking surface on one rod could be spaced axially between the locking surfaces on the other rod, which would then allow the locking segments to lock with one of the rods at 0.050" increments. In a preferred embodiment of the invention, four locking rods and four locking segments are provided. The axial position of the locking grooves on two diametrically opposed locking rods are identical, while the other two diametrically opposed rods have axially offset locking surfaces. High seal squeeze is thus obtained by the ram blocks, although the application of high axially directed opening forces applied to the ram shaft 24 does not tend to tilt the piston 30 within the cylinder 46. The same result could be obtained by offsetting the axial position of the mating surfaces on the locking segments, while corresponding locking surfaces on the rods remained at the same axial position.

The multiplicity of locking grooves are preferably provided along a relatively long axial length of each of the rods 42 or 142. Preferably the grooves extend over a length of at least 45% of the nominal diameter of the passageway 14 through the BOP body. This feature allows different ram blocks to be attached to the ram shaft of each actuator, so that locking will be effected over a wide or broad range of closing positions. Without adjusting the locking mechanism, the same actuator will automatically lock a "blind" ram block at complete BOP shutoff, and will lock a different ram block in its closed position with that ram block sealing against the largest diameter tubular which may be accommodated by the diameter of the passageway 14 through the BOP body 12. Between each of these positions are numerous other closed positions for the actuator, with each closed position being dependent upon the diameter of the tubular member 16 passing through the BOP, the wear on the ram block seals, and the configuration of the ram block. The locking mechanism of the present invention is thus effective over a full range of tubulars and ram blocks which may be used with the BOP, does not rely on fluid pressure to effect a lock, and need not rely upon frictional forces between locking components to maintain the ram shaft in a locked position.

In operation, ram blocks of a selected type and size will thus be placed on the ends of opposing actuators for achieving their desired purpose of sealing a flow path through the BOP once the actuators are closed. Pressurized fluid from the surface may be pumped to the subsea wellhead containing the BOP, and during normal drilling service or production operations the actuators remain in their opened position. If the BOP is to be closed, pressurized fluid is passed through the port or fluid line 36 in the cylinder head 32 (see FIG. 2) and into the chamber 47 to move the power piston 30 to its closed position. During closing of the actuator, the locking segments 92 or 192 ratchet along the grooves in the rods 42 of 142, respectively. The piston 30 need not reach any particular closed position for the locking mechanism to be effective, since the locking segments and the piston are continuously and automatically prevented from moving back to an open position due to the locked engagement of the locking segment 92 with the surface 124 on the last locking groove to receive a mating surface 110. If the actuator is prevented from reaching its intended fully closed position to completely seal off the flow path through the BOP, the actuator remains locked in its partially closed position and thus serves a useful function of at least limiting flow of well fluids through the BOP. During this actuator closing operation, the unlocking piston 80 is moved axially to or maintained at its unlocking position as shown in FIG. 2 due to fluid pressure acting on piston 80. Also, pressurized fluid fills the locking rod cavities 68 as the power piston 30 moves to its closed position. Once closed, the actuator will remain in a closed position regardless of whether fluid pressure in the chamber 47 is maintained. If closing fluid pressure is maintained but the sealing force on the ram block is reduced, or if closing pressure is increased, the piston 30 may move further closed to increase the sealing pressure on the ram block, and the locking segments will ratchet to lock with the next groove on the locking rods.

To open the actuator 20, fluid pressure is vented at line 36 and is intentionally applied to the port or fluid line 58. Pressurized fluid passes through line or port 59 in the mandrel 60, and acts on the unlocking piston 80. Piston 80 is accordingly moved axially toward the locking segments, thereby retracting the locking segments from engagement with the locking rods. During unlocking, a pressurized fluid in chamber 23 is also acting on the piston 30, although the piston 30 is prevented from moving until the locking segments disengage the locking rods. Moreover, close tolerances between the outer surface of the locking rods 42 (or the outer surface 144 of the end cap 146) and the inner diameter of the cavities 68 prevent the piston 30 from surging toward the cylinder head, since fluid in the cavities 68 must pass slowly by the grooves on the locking rods 42 or between the sidewalls of the cavities 68 and the cylindrical outer surface 144 of the end cap 146 for the piston 30 to move to its open position. It is a feature of the present invention that the same pressurized fluid acts on both the unlocking piston 80 to disengage the locking segments from the locking rods and then the power piston 30 to move the piston 30 to its open position.

One of the features of the present invention is that existing BOP actuators can be retrofitted to include the automatic locking features of the present invention. Since all of the locking components are housed within the cylinder 46, the size of the blowout preventor need not necessarily be increased.

Various modifications may be made to the embodiments disclosed herein without departing from the scope of the present invention. For example, biasing devices other than coil springs may be used to bias the locking segments into engagement with the locking rods. If desired, fluid pressure from one line may be applied to the unlocking piston to retract the locking segments from the locking rods, with fluid pressure thereafter first applied to the power piston to move the piston to its opened position. One locking rod may be utilized, in which case the free end of the locking rod may extend into an axially centered cavity in the end 78 of the working piston 30. The locking rods may be preferably secured to the cylinder head which defines the ram closing chamber, although the locking rods could be mounted within the cylinder bore to the cylinder head or door which defines the ram opening chamber. Locking rods having cylindrical or semi-cylindrical configurations are disclosed, although other cross-sectional configurations may be employed. A plurality of mating grooves are preferably provided on each locking segment, although the number of axially spaced grooves or teeth on the locking segments is not critical provided the locking force can be reliably transmitted to the locking rods.

The foregoing disclosure and description of the invention are thus illustrative and explanatory, and various changes in the method steps as well as in the details of the illustrative apparatus may be made within the scope of the appended claims without departing from the present invention.

What is claimed is:

1. A fluid-powered blowout preventor actuator for opening and closing one of a pair of opposing ram blocks movable within a blowout preventor body in response to a pressurized fluid source to control flow of well fluids through the blowout preventor, the blowout preventor having a through passageway for receiving tubular members extending into a well bore, the blowout preventor actuator comprising:

a cylinder having an inner bore defining an axis;

a power piston axially movable within the cylinder bore and separating the bore into a ram closing chamber and a ram opening chamber the power piston having one or more axially extending locking rod cavities therein;

a cylinder head for sealed engagement with an end of the cylinder;

a fluid closing line in communication with the pressurized fluid source for applying pressurized fluid to the ram closing chamber to move the power piston within the cylinder bore toward a ram closed position;

a ram shaft extending from the cylinder for mechanically interconnecting the power piston and the ram block;

one or more locking rods each secured at a first end to the cylinder head and having an opposing second end movable within the corresponding axially extending cavity of the power piston, each locking rod having a multiplicity of axially spaced locking surfaces thereon;

one or more locking segments each carried by the power piston and having a mating surface for locked engagement with a locking surface of a corresponding locking rod to prevent the power piston from moving within the cylinder bore to open the ram block;

a biasing device for biasing each of the one or more locking segments toward engagement with a respective locking rod;

an unlocking unit for selectively moving each of the locking segments out of engagement with the corresponding locking rod to unlock the power piston from the one or more locking rods and enable the ram block to move to a ram open position, the unlocking unit including an unlocking piston axially movable within the power piston in response to the pressurized fluid source and having guide surfaces thereon for limiting movement of each of the locking segments with respect to the power piston in a direction perpendicular to the axis of the cylinder bore, and one or more unlocking fingers each connected to the unlocking piston, each unlocking finger having a tapered surface for engaging a respective one of the locking segments to disengage the locking segment from the respective locking rod; and a fluid opening line in communication with the pressurized fluid source for applying pressurized fluid to the ram closing chamber, such that pressurized fluid within the fluid opening line axially moves both the unlocking piston and the power piston.

2. The blowout preventor actuator as defined in claim 1, wherein:

each of the one or more locking rods includes external axially spaced grooves each forming one of the multiplicity of locking surfaces; and each of the one or more locking segments include a multiplicity of mating grooves each forming the mating surface for locked engagement with an external groove on the corresponding locking rod.

3. The blowout preventor actuator as defined in claim 2, wherein the one or more locking rods includes a plurality of locking rods each spaced radially a uniform distance from the axis of the cylinder bore.

4. The blowout preventor actuator as defined in claim 3, wherein the locking surfaces for one of the plurality of locking rods are axially offset from the locking surfaces for another of the plurality of locking rods.

5. The blowout preventor as defined in claim 1, wherein each of the multiplicity of axially spaced locking surfaces are inclined at least 80° with respect to the axis of the cylinder bore.

6. The blowout preventor as defined in claim 4, wherein each of the multiplicity of locking surfaces on each of the one or more locking rods are axially spaced a distance of less than 0.150 inches from an adjacent locking surface on the locking rod.

7. The blowout preventor as defined in claim 4, wherein the multiplicity of locking surfaces on each of the one or more locking rods extend axially along a length of at least 45% of the nominal diameter of the through passageway within the blowout preventor body.

8. A fluid-powered blowout preventor actuator for reciprocating a ram block between a ram open position and a ram closed position within a blowout preventor body in response to a pressurized fluid source to control flow of well fluids through the blowout preventor, the blowout preventor having a through passageway for receiving tubular members extending into a well bore, the blowout preventor actuator comprising:

a cylinder having an inner bore defining an axis;

a power piston axially movable within the cylinder bore from the ram open position to the ram closed position, the power piston having a plurality of axially extending locking rod cavities therein;

a cylinder head for sealed engagement with an end of the cylinder;

a ram shaft extending from the cylinder for mechanically interconnecting the power piston and the ram block;

a plurality of locking rods each secured at a first end to the cylinder head and having an opposing second end movable within a corresponding axially extending cavity of the power piston;

each of the plurality of locking rods having a multiplicity of axially spaced locking surfaces thereon each lying within a plane substantially perpendicular to the axis of the cylinder bore;

a plurality of locking segments each carried by and radially movable with respect to the power piston;

each of the locking segments having a mating surface thereon for locked engagement with a locking surface of a corresponding locking rod to prevent the power piston from moving within the cylinder bore to the ram open position; and an unlocking piston axially movable with respect to the power piston for selectively moving the locking segment out of engagement with the locking rod to unlock the power piston from the locking rod and enable the ram block to move to the ram open position.

9. The blowout preventor actuator as defined in claim 8, further comprising:

a spring carried by the power piston for biasing the locking segment toward engagement with the locking rod.

10. The blowout preventor actuator as defined in claim 8, further comprising:

each of the plurality of locking rods is spaced radially a uniform distance from the axis of the cylinder bore; and each of the plurality of locking segments is positioned on the power piston radially between the axis of the cylinder bore and a respective one of the locking rod cavities.

11. The blowout preventor actuator as defined in claim 8, further comprising:

the unlocking unit includes an unlocking piston axially movable within the power piston in response to the pressurized fluid source; and a fluid opening line in communication with the pressurized fluid source for applying pressurized fluid to the ram closing chamber, such that pressurized fluid within the fluid opening line axially moves both the unlocking piston and the power piston.

12. A method of operating a fluid-powered blowout preventor actuator to reciprocate a ram block between a ram open position and a closed position and thereby control flow of well fluids through a blowout preventor, the blowout preventor including a body having a through passageway for receiving tubular members of varying diameters extending into the well bore, the blowout preventor actuator including a cylinder having an inner bore defining an axis, a power piston axially movable within the cylinder bore, a cylinder head for sealed engagement with an end of the cylinder, and a ram shaft extending from the cylinder for interconnecting the power piston and the ram block, the method comprising:

(a) forming one or more axially extending locking rod cavities within the power piston;

(b) forming a multiplicity of axially spaced locking surfaces on one or more locking rods;

(c) securing a first end of each of the one or more locking rods to the cylinder head such that an opposing second end of each locking rod is positioned within a corresponding axially extending cavity of the power piston;

(d) forming a mating surface on one or more locking segments;

(e) positioning each locking segment on the power piston such that each locking segment is radially movable with respect to the corresponding locking rod;

(f) biasing each locking segment toward engagement with a respective locking rod:

(g) applying pressurized fluid to move the power piston to the ram closing position while each of the locking segments ratchets past the axially spaced locking surfaces on the corresponding locking rod and prevents the power piston from moving to the ram open position by engagement of a locking surface on the locking rod and a mating surface on the locking segment;

(h) thereafter moving each locking segment out of engagement with the corresponding locking rod to unlock the power piston from the one or more locking rods; and (i) applying pressurized fluid to move the power piston to the ram open position while the locking segments are moved out of engagement with the one or more locking rods.

13. The method as defined in claim 12, further comprising:

positioning an unlocking piston axially movable in the power piston; and steps (h) and (i) are formed by applying pressurized fluid to the unlocking piston and the power piston.

14. The method as defined in claim 12, further comprising:

forming each of the multiplicity of axially spaced locking surfaces on each of the one or more locking rods within a plane substantially perpendicular to the axis of the cylinder bore; and restricting movement of each of the locking segments with respect to the power piston in a direction substantially perpendicular to the axis of the cylinder bore.

15. The method as defined in claim 12, wherein the one or more locking rods includes a plurality of locking rods, and step (c) further comprises:

securing each of the plurality of locking rods to the cylinder head a uniform radial distance from the axis of the cylinder bore: and offsetting the axial position of the locking surfaces on one of the plurality of locking rods with respect to the mating surface on its corresponding locking segment from the axial position of the locking surfaces on another of the plurality of locking rods with respect to the mating surface on its corresponding locking segment.

16. The method as defined in claim 12, wherein in step (b) further comprises:

forming the multiplicity of locking surfaces on each of the one or more locking rods axially along the length of at least 45% of the nominal diameter of the through passageway within the blowout preventor body.

17. A fluid-powered blowout preventor actuator for reciprocating a ram block within a blowout preventor body in response to a pressurized fluid source to control flow of well fluids through the blowout preventor, the blowout preventor having a through passageway for receiving tubular members extending into a well bore, the blowout preventor actuator comprising:

a cylinder having an inner bore defining an axis;

a power piston axially movable within the cylinder bore from a ram open position to a ram closed position, the power piston having a plurality of axially extending locking rod cavities therein;

a cylinder head for sealed engagement with an end of the cylinder;

a ram shaft extending from the cylinder for mechanically interconnecting the power piston and the ram block;

a plurality of locking rods each secured at a first end to the cylinder head and having an opposing second end movable within the corresponding axially extending cavity of the power piston, each locking rod having a multiplicity of axially spaced locking surface thereon;

a plurality of locking segments each carried by the power piston and having a mating surface for locked engagement with a locking surface of a corresponding locking rod to prevent the power piston from moving within the cylinder bore to open the ram block; and an unlocking unit for selectively moving each of the locking segments out of engagement with the locking rods to unlock the power piston from the locking rods.

18. The blowout preventor as defined in claim 17, wherein each of the plurality of locking rods is spaced radially a uniform distance from the axis of the cylinder bore.

19. The blowout preventor as defined in claim 17, wherein:

each of the plurality of locking rods includes external axially spaced grooves each forming one of the multiplicity of locking surfaces; and each of the plurality of locking segments includes a multiplicity of mating grooves each forming a mating surface for locked engagement with an external groove on the corresponding locking rod.

20. The blowout preventor as defined in claim 17, wherein the locking surfaces for one of the plurality of locking rods are axially offset from the locking surfaces for another of the plurality of locking rods.

21. The blowout preventor as defined in claim 17, wherein:

each of the multiplicity of axially spaced locking surfaces are inclined at least 80 degrees with respect to the axis of the cylinder bore; and each of the multiplicity of locking surfaces are axially spaced a distance of less than 0.150 inches from an adjacent locking surface on the locking rod.

22. The blowout preventor as defined in claim 17, wherein the multiplicity of locking surfaces on each of the plurality of locking rods extend axially along the length of at least 45 percent of the nominal diameter of the through passageway within the blowout preventor body.

23. The blowout preventor as defined in claim 17, further comprising:

a spring for biasing each of the plurality of locking segments toward engagement with the corresponding locking rod.

24. The blowout preventor as defined in claim 17, wherein each of the plurality of locking segments is positioned on the power piston radially between the axis of the cylinder bore and the respective locking rod cavity.

25. The blowout preventor as defined in claim 17, further comprising:

the unlocking unit includes an unlocking piston axially movable within the power piston in response to the pressurized fluid source; and a fluid opening line in communication with the pressurized fluid source for applying pressurized fluid to the ram closing chamber, such that pressurized fluid within the fluid opening line axially moves both the unlocking piston and the power piston.

26. The blowout preventor as defined in claim 17, wherein the unlocking unit comprising:

an unlocking piston axially movable within the power piston and having guide surfaces thereon for limiting movement of each of the plurality of locking segments with respect to the power piston in a direction substantially perpendicular to the axis of the cylinder bore; and one or more unlocking fingers each connected to the unlocking piston, each unlocking finger having a tapered surface for engaging a respective one of the plurality of locking segments to disengage the locking segment from the respect locking rod.

* * * * *

UNITED STATES PATENT AND TRADEMARK OFFICE

CERTIFICATE OF CORRECTION

PATENT NO. : 5,025,708

DATED : June 25, 1991

INVENTOR(S) : Denzil B. Smith and Melvyn F. Whitby

It is certified that error appears in the above-identified patent and that said Letters Patent is hereby corrected as shown below:

In Column 11, line 30 (Claim 1, line 12), insert "," after "opening chamber".

In Column 14, line 2 (Claim 12, line 31), change ":" to — ; --.

In Column 14, line 40 (Claim 15, line 6), change ":" to — ; --.

Signed and Sealed this

Third Day of November, 1992

*Attest:*

DOUGLAS B. COMER

*Attesting Officer*

*Acting Commissioner of Patents and Trademarks*